US009163368B2

(12) United States Patent
Asgari

(10) Patent No.: US 9,163,368 B2
(45) Date of Patent: Oct. 20, 2015

(54) PAVEMENT MARKING ARRANGEMENT

(76) Inventor: Sepehr Asgari, Carmel, IN (US)

( * ) Notice: Subject to any disclaimer, the term of this patent is extended or adjusted under 35 U.S.C. 154(b) by 843 days.

(21) Appl. No.: 12/887,723

(22) Filed: Sep. 22, 2010

(65) Prior Publication Data

US 2012/0070227 A1 Mar. 22, 2012

(51) Int. Cl.

| | |
|---|---|
| ***E01F 9/00*** | (2006.01) |
| ***E01F 9/08*** | (2006.01) |
| ***E01F 9/04*** | (2006.01) |

(52) U.S. Cl.

CPC .. *E01F 9/08* (2013.01); *E01F 9/041* (2013.01)

(58) Field of Classification Search

CPC ..... E01F 9/041; E01F 9/08
USPC ..... 404/72–75, 77, 93, 94, 82
See application file for complete search history.

(56) References Cited

U.S. PATENT DOCUMENTS

| | | | | | |
|---|---|---|---|---|---|
| 3,935,365 | A * | 1/1976 | Eigenmann | 428/323 |
| 4,071,384 | A * | 1/1978 | Eigenmann | 156/71 |
| 4,146,635 | A * | 3/1979 | Eigenmann | 442/68 |
| 4,443,510 | A * | 4/1984 | Watt | 428/149 |
| 5,035,531 | A * | 7/1991 | Sanchez | 404/12 |
| 5,039,557 | A * | 8/1991 | White | 427/137 |
| 5,139,590 | A * | 8/1992 | Wyckoff | 156/71 |
| 5,227,221 | A * | 7/1993 | Hedblom | 428/172 |
| 5,374,465 | A * | 12/1994 | Fulcomer | 428/172 |
| 5,453,320 | A * | 9/1995 | Harper et al. | 428/356 |
| 5,456,546 | A * | 10/1995 | Bollag | 404/9 |
| 6,020,073 | A * | 2/2000 | Wilson, Sr. | 428/489 |
| 6,127,020 | A * | 10/2000 | Bacon et al. | 428/161 |
| 7,150,581 | B2 * | 12/2006 | Lowe | 404/75 |
| 7,204,658 | B2 * | 4/2007 | Saito et al. | 404/94 |
| 7,429,146 | B2 * | 9/2008 | Hall et al. | 404/93 |
| 7,597,503 | B2 * | 10/2009 | Hinding et al. | 404/75 |
| 7,753,616 | B2 * | 7/2010 | Greer et al. | 404/12 |
| 2009/0202298 | A1 * | 8/2009 | Bjorklund | 404/77 |
| 2010/0279064 | A1 * | 11/2010 | Pacey | 428/137 |

FOREIGN PATENT DOCUMENTS

| | | | |
|---|---|---|---|
| GB | 2437085 | * 10/2007 | E01F 9/04 |

* cited by examiner

*Primary Examiner* — Raymond W Addie
(74) *Attorney, Agent, or Firm* — Bingham Greenebaum Doll LLP

(57) ABSTRACT

A method of marking pavement includes applying a first layer of liquid tar to the pavement. The layer has a thickness of approximately between 0.01 inch and 0.1 inch, and a width of approximately between one inch and six inches. A layer of rubber is placed on top of and centered on the layer of tar. The layer of rubber has at least one vertically-oriented through-hole sized to allow liquid tar to flow therethrough. A second layer of liquid tar and reflective elements is applied on top of the layer of rubber sheet. Enough time is allowed to pass for the first and second layers of tar to cool and become solidified. Paper is adhered to a top surface of the second layer of tar and/or reflective elements. The paper and an adjacent portion of the pavement is painted over to thereby form a painted marking.

4 Claims, 5 Drawing Sheets

PAVEMENT MARKING ARRANGEMENT

BACKGROUND

The present invention relates to systems and methods for marking pavement, such as asphalt used in making roads.

Pavement (asphalt) is initially black, but as it ages its color turns gray and eventually whitish gray. Concrete roads are whitish gray even when they are new. Hence, most roads are whitish gray in color.

Traffic markings are put down on roads in order to guide vehicle traffic. Such markings include lane dividers and turn arrows. A problem is that such traffic markings are typically white and yellow/orange, which has good contrast with, and visibility on, fresh black pavement, but has decreasing contrast, and decreasing visibility, as the asphalt turns whitish gray with age.

SUMMARY

The present inventor has observed that black markings are more visible on concrete roads as well as on older pavement (whitish gray) roads. Accordingly, the present invention provides a combination of white and black markings on pavement (roads) or yellow/orange and black markings on pavement. Such markings have a higher contrast and are more visible on both black and whitish gray color pavement roads than are markings without any black color.

Markings may be provided in a combination of white and black, or of yellow/orange and black, with many variations. Any regular or irregular black color shapes may be used to provide one or more road markings.

The materials used may include, but are not limited to, the following:

1. Black paint or black metallic silver paint.
2. Tar.
3. Tar plus other additives for strengthening and/or to make the tar more shiny (e.g., reflective of light) and more solid in regular or higher temperatures.
4. Tar plus shiny materials (including small pieces of glass or recycled glass or small shiny (reflective) sand and/or glitter and/or small pieces of aluminum foil and/or other reflective materials).
5. Thin (about two times the thickness of regular paper sheets) pieces or sheets of rubber, (perhaps manufactured or made from recycled or reused car tires or other used materials) with many holes through the pieces of rubber in order to receive sticky tar and thereby help keep the rubber in one place rather than moving on the pavement after installation. The holes also help to keep the rubber flat on the road. Warm or hot tar may be applied on one side or both sides of the rubber pieces so that the tar passes through the holes. The holes make the rubber flat on both sides of the rubber, and the sticky tar in the holes and in contact with the pavement helps the rubber pieces to stay in place and keep from moving and being uninstalled.
6. White paper may be applied to the side of the rubber facing up, and the tar adheres the paper to the rubber. The tar, rubber and paper are allowed to cool to thereby become solid (not liquid tar). Theses tar- and paper-covered rubber pieces or "black markings" are placed on the road (asphalt pavement or concrete) where the pavement is intended to be marked. The tar is on both sides of the rubber piece (facing down an up) so that the rubber contacts and sticks to both the road and the paper.

7. White paint may then be applied as a road marking on top of the white paper as well as beyond the boundaries of the white paper. The white paint may be put down in the shape of a rectangular lane divider, or a turn arrow, for example. The area of the white painted pavement may be several times larger than the rubber pieces. The heat from the road and sun eventually melts the tar to act like glue between the rubber pieces and the road. The tar sticking to the pavement and extending up through the holes in the rubber functions to keep the rubber from moving or being removed from the road by the forces of the traffic. The white paper on top of the rubber and tar masks the rubber and tar from the white paint. The weather (heat, cold, rain) and pressure from car traffic on the marking eventually decomposes and/or separates and removes the paper and the paint thereon from the rubber and tar layers underneath the paper. The black tar, rubber, and shiny or reflective additives uncovered by the paper appear in sharp contrast to the white painted color marking on the road. The paper may also be removed by applying a flame, such as a torch, to the paint that is just above the white paper in order to burn off the paint and the paper as well as melt the tar underneath the paper/paint layer. Thus, the melt tar adheres, gets glued to, and/or sticks to the rubber layer and to the road.

An advantage of the present invention is that the markings have superior visibility on both black and whitish grey pavement.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
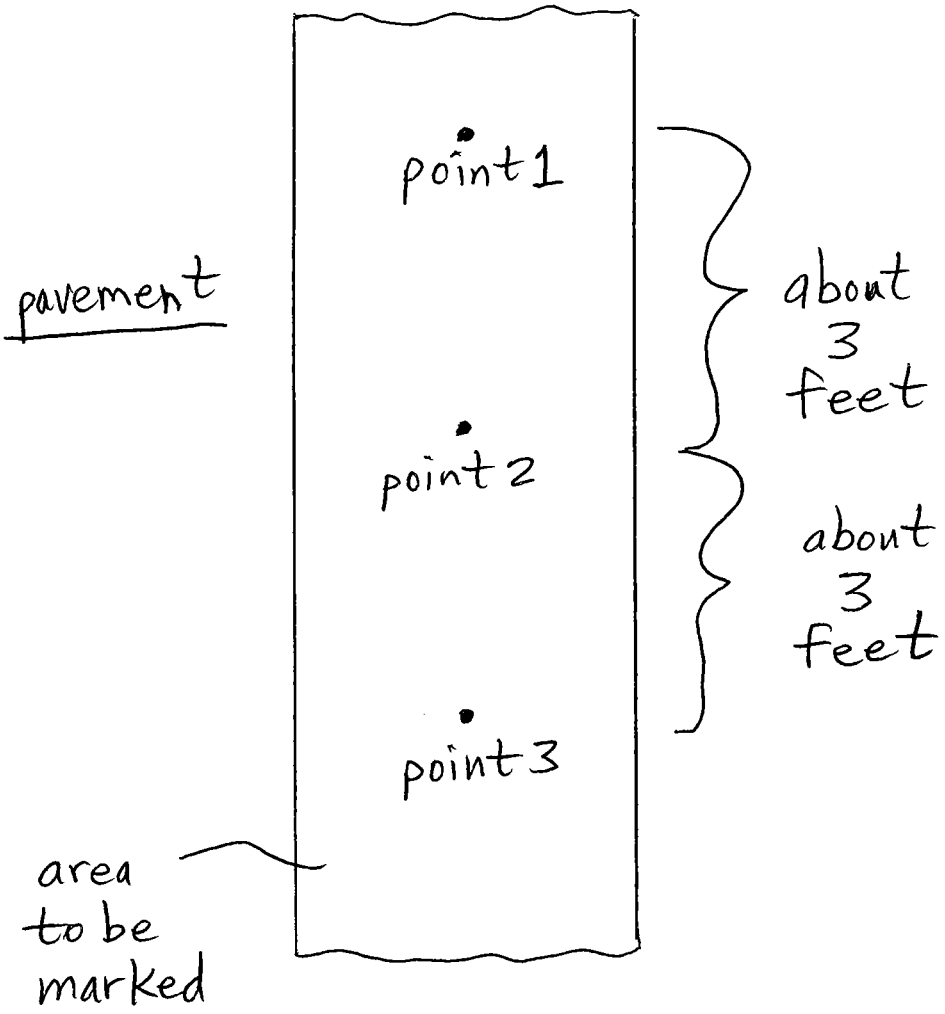
FIG. 1 is a plan view of a planned road marking with evenly spaced points identified along its length.

Corresponding reference characters indicate corresponding parts throughout the several views. Although the drawings represent embodiments of the present invention, the drawings are not necessarily to scale and certain features may be exaggerated in order to better illustrate and explain the present invention. Although the exemplification set out herein illustrates embodiments of the invention, in several forms, the embodiments disclosed below are not intended to be exhaustive or to be construed as limiting the scope of the invention to the precise forms disclosed.

DETAILED DESCRIPTION

The embodiments hereinafter disclosed are not intended to be exhaustive or limit the invention to the precise forms disclosed in the following description. Rather the embodiments are chosen and described so that others skilled in the art may utilize its teachings.

The steps of one embodiment of laying down a pavement marking arrangement of the invention are now described with reference to the drawings, wherein like numerals indicate like elements.

Step 1—Locate where the traffic marking is to be placed on the road. The markings may include white or yellow line segments and arrows, for example.

Step 2—Located a plurality of evenly spaced points (FIG. 1) along the middle of the area where the marking is to be placed. The points may be about three feet apart.

Step 3—Heat solid, high density tar until the tar is liquefied (e.g., flows easily).

Figure 3:
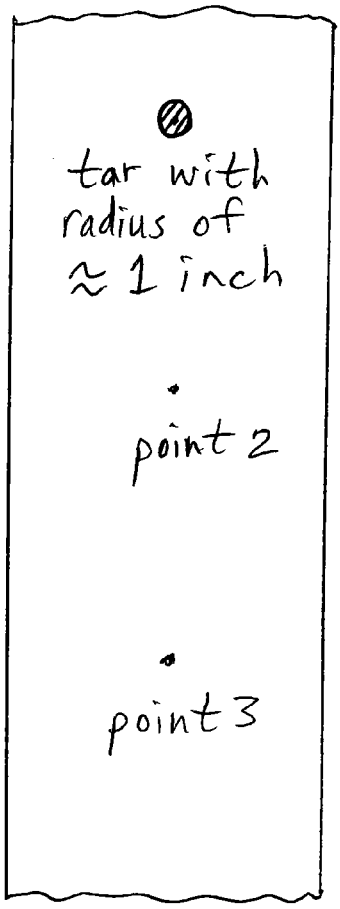
FIG. 3 is a plan view of FIG. 2.
Figure 2:
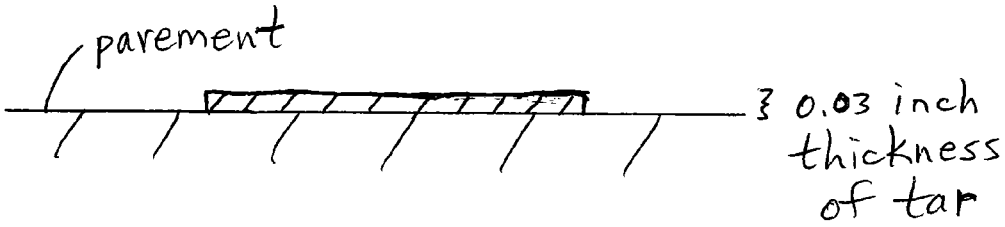
FIG. 2 is a cross-sectional view of tar applied to point 1 of FIG. 1.

Step 4—Pour/apply liquid tar on point 1 until it forms a circle with radius of about one inch and thickness of about 0.03 inch, as shown in FIGS. 2 and 3. The tar may need to be pressed down after pouring or other application.

Figure 5:
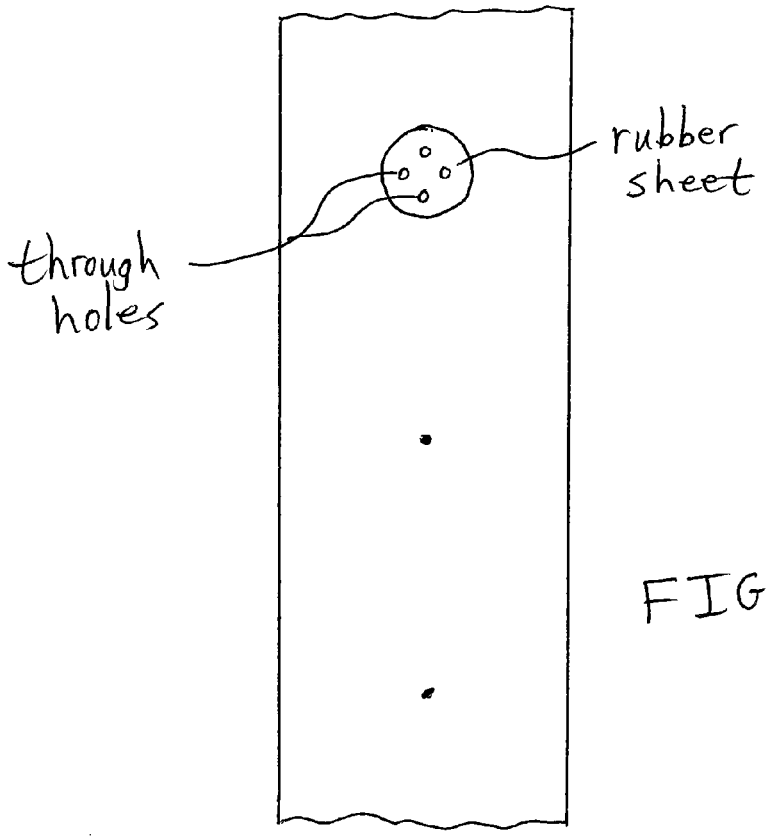
FIG. 5 is a plan view of FIG. 4.
Figure 4:
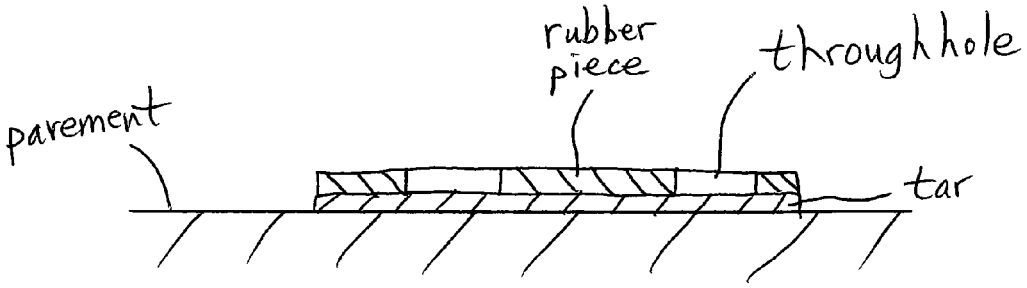
FIG. 4 is a cross-sectional view after a rubber piece has been applied to the tar of FIG. 2.

Step 5—Place a circular, one-inch-radius rubber sheet on top of and centered on the tar at point 1 while the tar is still hot and in a liquid state, as shown in FIGS. 4 and 5. The rubber sheet may completely cover the tar. The sheet has throughholes wide enough to allow the tar to flow therethrough. In one embodiment, the throughholes have radius of 0.03 inch, and the rubber sheet is 0.03 inch thick. The throughholes may be about a half inch from the center of the sheet, evenly spaced from each other.

Step 6—Pour additional hot, high density tar in liquid form on top of the rubber sheet to cover the sheet completely with a thickness of about 0.03 inch of liquid tar.

Figure 6:
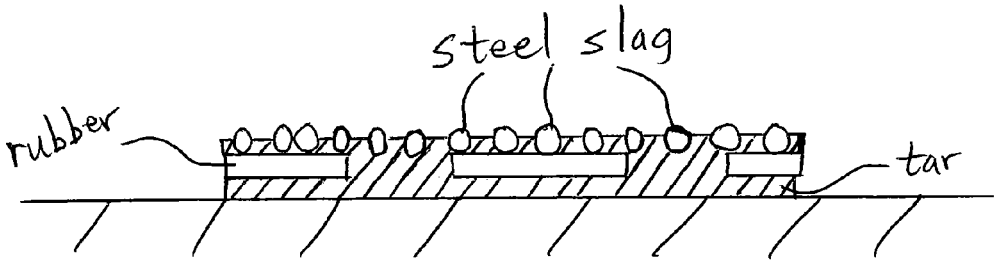
FIG. 6 is a cross-sectional view of after slag and another layer of tar has been applied to the rubber piece of FIG. 4.

Step 7—Drop reflective elements, such as steel slag, on top of tar until the tar is saturated with the slag. The slag sinks into and merges with the tar, and comes to rest on the rubber sheet. Before application, the steel slag may be grinded into small spherical shapes of about 0.04 inch in diameter. As shown in FIG. 6, because the height of the slag is greater than the thickness of the tar layer, the slag sticks out or stands above the upper surface of the tar. Thus, the exposed portion of the slag may reflect light and provide a shiny appearance.

Figure 7:
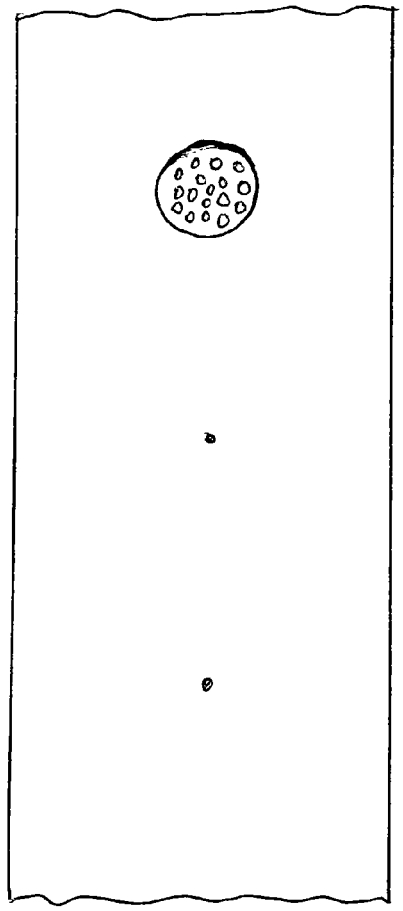
FIG. 7 is a plan view of FIG. 6.

Step 8—Allow the assembly of FIGS. 6 and 7 to cool down until it is completely in a solid state.

Step 9—Apply glue to the top surface of the steel slag and tar.

Step 10—Press onto the still wet glue white or yellow paper having a same size and shape as the upper layer of steel slag and tar so that the slag and tar is completely covered by the paper. The paper functions as a mask for a subsequent paint application.

Step 11—Repeat Steps 1-10 for all other points within the area to be marked.

Step 12—Paint over the area to be marked, including the paper, with white/yellow paint such that the entire area to be marked is covered with paint. The area to be marked may typically be a line segment lane divider or an arrow. The paint may have a thickness of about 0.09 inch such that the upper surface of the paint is flush with the upper surface of the top layer of tar.

Figure 8:
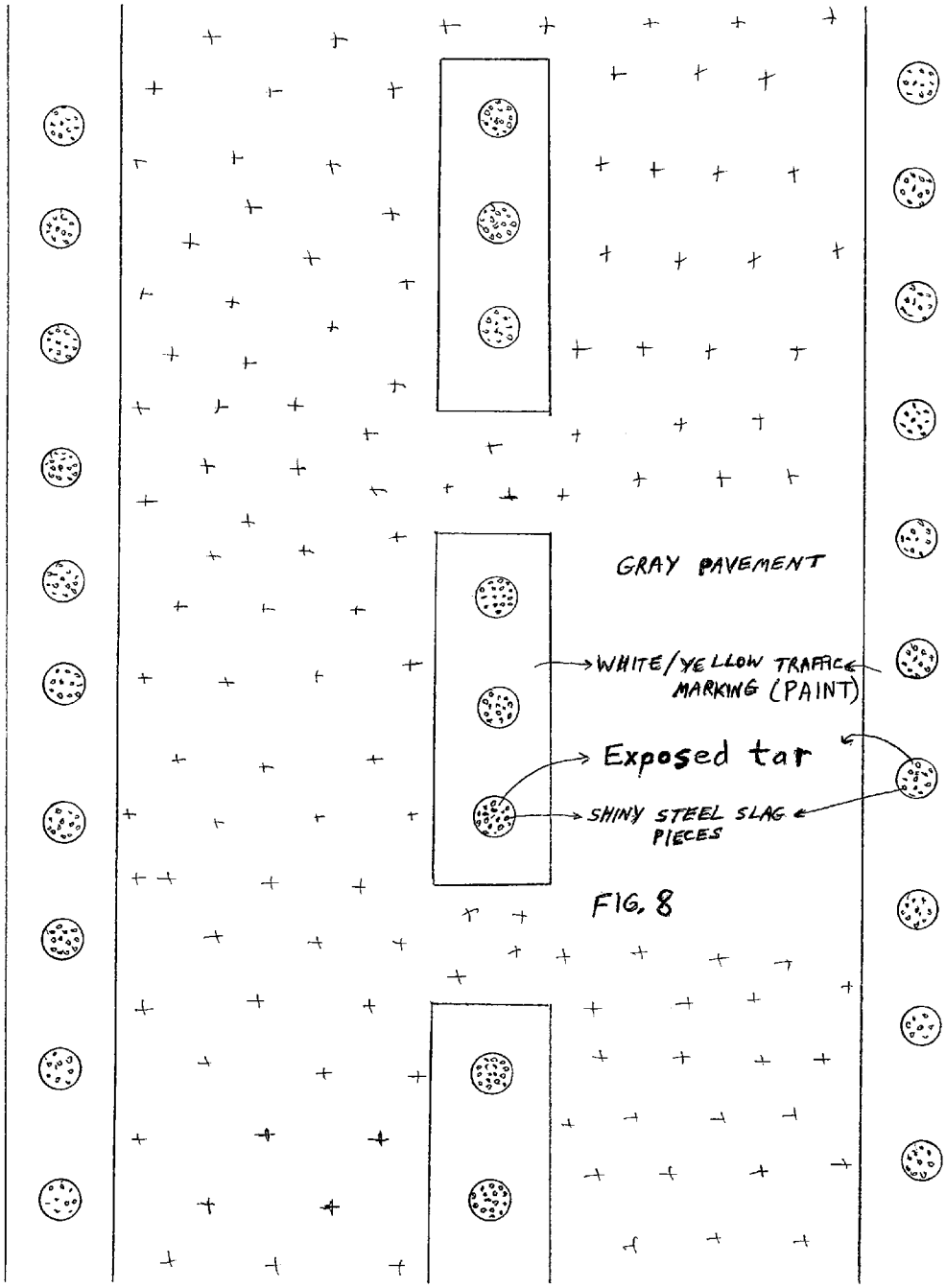
FIG. 8 is a plan view after paint has been applied as the traffic marking, and after the paper has disintegrated or peeled off.

In time, after Steps 1-12, the combination of weather conditions (e.g., sun, rain, heat, etc.) and pressure from the weight of vehicular traffic causes the paper to disintegrate or peel off, leaving the shiny steel slag and tar exposed and surrounded by the white/yellow painted traffic marking, as shown in FIG. 8. Thus, an excellent contrast between the white/yellow paint and the black tar with shiny slag is provided, which makes the traffic marking very easy for drivers to see. Even as the road surface becomes more whitish with age, the visibility of the contrast between the black tar and the white/yellow paint remains substantially the same.

Because most of the materials used in the inventive arrangement (e.g., tar, steel slag) are the same as the material of the asphalt/pavement, the arrangement may last as long as the road itself. Thus, the arrangement has a much longer lifetime than the white/yellow markings. When the white/yellow markings need to be repainted, the tar and slag may again be covered with adhesive paper, and the entire marking may be repainted again. The paper will again disintegrate to provide sharp contrast between the black tar and the fresh white paint.

The thicknesses of the layers of tar and rubber may be correspondingly greater if the thickness of the layer of paint surrounding these layers is determined to be greater than 0.09 inch.

The steel slag may be mixed with the tar before being applied to the rubber.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A method of marking pavement, comprising the steps of:

applying a first layer of liquid tar to the pavement, the layer having a thickness of approximately between 0.01 inch and 0.1 inch, and a width of approximately between one inch and six inches;

placing a layer of rubber on top of and centered on the layer of tar, the layer of rubber having at least one vertically-oriented throughhole sized to allow liquid tar to flow therethrough;

applying a second layer of liquid tar and reflective elements on top of the layer of rubber sheet;

allowing enough time to pass for the first and second layers of tar to cool and become solidified;

adhering paper to a top surface of the second layer of tar and/or reflective elements;

painting over the paper and an adjacent portion of the pavement to thereby form a painted marking; and allowing weather conditions and pressure from vehicular traffic to cause the paper to disintegrate or peel off the top surface of the second layer.

2. The method of claim 1, wherein the disintegrating or peeling off of the paper leaves the second layer exposed.

3. The method of claim 2, wherein the exposed second layer is surrounded by the paint.

4. The method of claim 3, wherein the paint is white or yellow.

* * * * *